US011493209B2

(12) United States Patent
Arts et al.

(10) Patent No.: US 11,493,209 B2
(45) Date of Patent: Nov. 8, 2022

(54) LINER DEVICE FOR A FURNACE

(71) Applicant: Industrial Ceramic Linings B.V., Rotterdam (NL)

(72) Inventors: Sebastian Dominique Arts, Rotterdam (NL); Daan Yuri Langelaan, Rotterdam (NL)

(73) Assignee: Industrial Ceramic Linings B.V., Rotterdam (NL)

( * ) Notice: Subject to any disclaimer, the term of this patent is extended or adjusted under 35 U.S.C. 154(b) by 93 days.

(21) Appl. No.: 16/750,044

(22) Filed: Jan. 23, 2020

(65) Prior Publication Data

US 2021/0231315 A1 Jul. 29, 2021

(51) Int. Cl.

| | |
|---|---|
| ***F23M 9/00*** | (2006.01) |
| ***F23D 14/62*** | (2006.01) |
| ***F23M 5/04*** | (2006.01) |
| ***F24D 5/04*** | (2006.01) |

(Continued)

(52) U.S. Cl.

CPC ..... *F24D 5/04* (2013.01); *F23D 14/62* (2013.01); *F23M 5/04* (2013.01); *F23M 9/003* (2013.01); *F24D 5/10* (2013.01); *F24D 19/1084* (2013.01); *F23D 2900/00018* (2013.01); *F24D 2220/06* (2013.01)

(58) Field of Classification Search

None

See application file for complete search history.

(56) References Cited

U.S. PATENT DOCUMENTS 2,336,816 A * 12/1943 Thompson ..... F24C 3/042 431/329

2,877,008 A * 3/1959 De Mattia ..... B65D 7/14 432/261

(Continued)

FOREIGN PATENT DOCUMENTS

WO 2019014543 1/2019

*Primary Examiner* — Avinash A Savani

*Assistant Examiner* — Deepak A Deean

(74) *Attorney, Agent, or Firm* — N.V. Nederlandsch Octrooibureau

(57) ABSTRACT

Liner device, adapted to be mounted between a burner box and a tube interface plate of a furnace. The liner device includes a base section, one or more tube sections, and one or more angle fasteners. The base section includes a shielding layer formed from a first flexible mesh of flame-resistant fibers, the shielding layer defining a first surface that is configured to face the burner box, a second surface opposite to the first surface, and a medial region with a through-hole forming a passageway through the shielding layer. The tube section is composed essentially of a second flexible mesh of flame-resistant fibers formed into a tubular shape that defines an internal channel around a nominal axis. A proximal end of the tube section is positioned at the base section, such that the channel opens into the through-hole and that the tube section projects from the second surface and in a direction faced by the second surface. The angle fastener has a base portion that is positioned along and fixed to the second surface of the shielding layer. The angle fastener further has a leg portion that projects towards the second direction and is positioned along and fixed to an outer surface of the tube section at or near the proximal end thereof.

18 Claims, 5 Drawing Sheets

(51) Int. Cl.
*F24D 19/10* (2006.01)
*F24D 5/10* (2006.01)

(56) References Cited

U.S. PATENT DOCUMENTS 3,156,972 A * 11/1964 Cimochowski ..... F24B 13/02 29/890.031
3,391,983 A * 7/1968 Harazono ..... F23D 14/145 431/329
4,523,531 A * 6/1985 Bishara ..... F27D 1/14 110/336
4,649,894 A * 3/1987 Hoeffken ..... B23P 11/00 126/119
4,938,283 A 7/1990 Wood et al.
7,726,386 B2 * 6/2010 Specht ..... F28F 17/005 165/134.1
2003/0015812 A1 * 1/2003 Opatt ..... F27D 1/1626 264/30
2013/0137052 A1 * 5/2013 Laskowski ..... F23K 3/00 431/12
2015/0192291 A1 * 7/2015 Akbarimonfared ..... F23D 14/14 126/116 R
2015/0369495 A1 * 12/2015 Maricic ..... F24D 19/1084 126/116 A
2016/0040905 A1 * 2/2016 Shellenberger ..... F24H 9/1881 126/116 R
2017/0009982 A1 * 1/2017 Garloch ..... F23D 14/02
2017/0191307 A1 * 7/2017 Bond ..... E06B 3/60
2017/0241666 A1 * 8/2017 Kowald ..... F24H 9/1881
2017/0241668 A1 * 8/2017 Kowald ..... F24H 9/0073
2018/0356106 A1 12/2018 Christopher
2019/0101282 A1 * 4/2019 Perez ..... F23L 17/005
2021/0088211 A1 * 3/2021 Daddis ..... F23D 14/145

* cited by examiner

LINER DEVICE FOR A FURNACE

TECHNICAL FIELD

The invention relates to a liner device for mounting between a burner box and a tube interface plate of a furnace, to a furnace including such a liner device, and to a method of manufacturing such a liner device.

BACKGROUND ART

Hot air furnaces are a common component of many commercial and residential heating, ventilation, and air conditioning (HVAC) systems. Such furnaces typically include at least one burner for combusting a liquid or gaseous hydrocarbon fuel, such as natural gas. The burner in such a system is typically located external to a set of heat exchanger (HE) tubes, and receives a flow of fuel from a fuel source. An ignition source inside the burner ignites the fuel, to create a flame and hot flue gasses that project from the combustion region into the HE tubes. The hot flue gasses flowing inside the HE tubes, transfer their thermal energy via the walls of the HE tubes to a flow of air that is conveyed along outer surfaces of the HE tubes.

A known type of furnace burner is a "premix burner", in which fuel and air are mixed inside a burner inlet valve, before being injected into a combustion zone where an ignition source ignites the mixture. Premix burners typically emit lower levels of nitrogen oxides (NOx), compared to inshot burners that do not have such an air-premixing stage. Pre-mix burners are preferred to be used in heating systems, particularly in those countries in which stricter regulations on NOx emissions apply.

Patent document US 2019/0101282 A1 describes a known pre-mix type burner box assembly for a furnace burner, which forms part of a HVAC system. This assembly includes a heat-resistant liner, which lines an interior of an outer cover that defines a box-shaped recess with apertures. This cover forms an interface structure between an array of HE tubes mounted on one side, and the burner box mounted on an opposite side. This liner is composed of panel members, which are formed into a box-shaped structure with an open rear face that is exposed to the flames inside the pre-mix burner, and which are made of heat-resistant material such as nickel/chromium alloy or ceramic wafer board. The liner additionally includes tubular members, designed to be placed through the apertures of the outer cover in order to line the HE tubes on their inner sides. This known liner is said to reduce peak temperatures and formation of hot spots within the burner box assembly.

However, US2019/0101282 fails to reveal details on how the various parts of this known liner have to be constructed, in order to ensure that peak temperatures and hot spots are indeed avoided and that this liner has good mechanical and thermal insulation properties.

It would be desirable to provide a liner device for a furnace, which is easy to manufacture yet retains its mechanical robustness and heat insulating properties when subjected to harsh high-temperature conditions inside the furnace for prolonged times.

SUMMARY OF INVENTION

Therefore, according to a first aspect of the invention, there is provided a liner device that is adapted to be mounted between a burner box and a tube interface plate of a furnace. The liner device includes a base section, at least one tube section, and one or more angle fasteners. The base section includes a shielding layer formed from a first flexible mesh of flame-resistant fibers. This shielding layer defines a first surface that is configured to face the burner box, a second surface opposite to the first surface, and a medial region with a through-hole forming a passageway through the shielding layer. The tube section consists essentially of a second flexible mesh of flame-resistant fibers formed into a tubular shape that defines an internal channel around a nominal axis. The tube section is positioned with its proximal end at the base section, such that the channel opens into the through-hole and that the tube section projects from the second surface and in a direction faced by the second surface. The angle fastener has a base portion that is positioned along and fixed to the second surface of the shielding layer. The angle fastener further has a leg portion that projects towards the second direction, and which is positioned along and is fixed to an outer surface of the tube section at or near the proximal end thereof.

This angle fastener forms a structure that is distinct from the tube and base sections. By not forming the fastener as a continuation of the materials from which the tube and base sections are made, the probability of exerting local stress onto the tube or base sections when the fastener is folded and attached—which may cause the tube and base sections to warp and/or misalign during manufacturing—is reduced. The separate angle fastener on the rear side of the base section and on the outer lateral side of the tube section provides a reliable mechanical interconnection between these sections, while the base section and tube section(s) shield the angle fastener from direct exposure to flames and excessive heat during furnace operation. This yield a robust liner device with good thermal insulation properties, which is flexible and easy to install and replace.

In this context, the term "mesh" is used to refer to a network of interconnected strands/wires. On a macroscopic scale, this network extends as a surface contour in three dimensions, for instance as a planar surface or as a more complex folded/curved surface structure. The strands/wires may be formed by continuous fibers (i.e. mono-filament), by continuous yarns (i.e. intertwined fibers), or by continuous twines (i.e. intertwined yarns or bundles of fibers) made of such fibers. These strands/wires are arranged in a periodic and structured orientation relative to each other, while extending with their elongated direction predominantly along the direction of the mesh surface. The strands/wires may be interconnected in a rigid manner (e.g. by intersecting in preformed single body node points, or by welding/adhering to each other), or in a loose indirect manner (e.g. by abutting each other at crossing points, while allowing for some relative sliding motion). The mesh strands/wires may be arranged closely together in a tightly packed manner i.e. without defining openings in-between the strands/wires, or may be arranged further apart so that openings are defined in-between the strands/wires.

In this context, the phrase "flame resistant material" is used herein to refer to materials (e.g. fabrics) that consist entirely or predominantly of materials that are inherently non-flammable i.e. which, when in close proximity to flames inside a furnace, will not melt, combust, or fracture, and will not burn or only burn to such minor extent that the material is able to extinguish the burning by itself. A "flame resistant object" can be entirely made of flame resistant material, or partially made of flame resistant material and partially made of burnable material. When subjected to flames in a furnace, the burnable material will burn away, but the remaining structure defined by the flame resistant material will remain intact.

The base section (in particular the shielding layer) is preferably formed into a planar shape or a curved developable shape. This rest shape (i.e. in absence of net forces) substantially matches the local surface contours of the tube interface plate onto which the device is installed.

The fibers of the shielding layer are preferably interwoven to form a closed mesh, in order to prevent impinging combustion flames from passing through shielding layer. Alternatively, the shielding layer may be formed by an open mesh, although this leaves the subsequent layer(s) exposed to flames, and might render the shielding layer plastically stretchable along its plane.

In embodiments, the base portion of the angle fastener forms an integral part of an attachment layer that covers the second surface of the shielding layer along at least the medial region. This attachment layer includes a cutout having a shape that is circumscribed by the periphery of the through-hole. The cutout extends locally and radially inwards to define at least one tab, which forms the leg portion of the angle fastener when it is flexed towards the second direction.

A continuous attachment layer, forming a unitary base portion from which the one or more leg portions of the angle fastener(s) protrude, allows the angle fastener(s) to be quickly and accurately aligned with the shielding layer. In device embodiments with multiple tube sections, the base portions of angle fasteners for distinct tube sections may be in a contiguous arrangement and be connected together, so as to form a unitary attachment layer that extends across the entire base section.

In alternative embodiments, the angle fasteners may form unconnected and mutually separated units that are associated with individual tube sections. An angle fastener may for instance be formed as an annular patch with a single cutout that matches the through-hole, and with one or more tabs forming flexible leg portions as described above. Alternatively, the angle fastener may be shaped as an L-bracket, or as a flanged bush.

In further embodiments, the attachment layer defines at least three tabs that protrude from the edge of the through-hole. These tabs are arranged in an approximately regular angular distribution around the edge of the through-hole, forming leg portions of three respective angle fasteners associated with the same tube section.

Placing the three tabs in a regular distribution (i.e. in a mirror and/or rotationally symmetrical arrangement) around the through-hole yields good stability of the mechanical connection with minimal use of material. The three tabs may for instance be arranged in a 120°-degree rotationally symmetric manner around the through-hole. However, in device embodiments with multiple tube sections and through-holes close to each other, this symmetry may be slightly deviated from, by placing two of the tabs about 5°-20° closer to each other. This ensures that a staple/sewing device for fixing the tubes will not be obstructed by adjacent tube sections.

In embodiments, the attachment layer is formed by an open mesh or punched sheet. This open mesh or punched sheet has a low bending resistance against out-of-plane flexing, and a high shear resistance against in-plane deformation.

An open mesh or punched foil facilitates creating interconnections by sewing or stapling techniques, without having to align the attachment layer accurately with predetermined attachment points in the other layers.

In embodiments, the leg portion of the angle fastener is fixed to the outer surface of the tube section using flame-resistant staples or stitches made of flame-resistant yarn. Alternatively or in addition, the base portion of the angle fastener may be fixed to the second surface of the shielding layer using flame-resistant staples or stitches made of flame-resistant yarn.

Using flame-resistant stitches and/or staples for mechanically fixing the various parts together obviates the need for chemical bonding agents (e.g. adhesives), thus avoiding associated risks of chemical bond failure and pollution.

In embodiments, the shielding layer further defines a peripheral region that surrounds the medial region. The liner device may then further include an insulating layer that is fixed to and overlaps with the second surface of the shielding layer along at least the entire peripheral region. This insulating layer is compressible and is configured to form a gasket between the mounting flanges of the burner box and the interface plate of the furnace.

The provision of a compressible insulating layer along the peripheral region of shielding layer will reduce leakage of combustion gasses from the burner box, without having to install a separate gasket.

In further embodiments, the flexible and compressible material of the insulating layer consists essentially of thermally insulating mineral wool. The insulating layer defines a further through-hole and overlaps the second surface of the shielding layer along the medial region such that the through-hole and further through-hole align. The insulating layer also overlaps the base portion of the angle fastener, such that the shielding layer and the insulating layer enclose the base portion on opposite sides thereof.

The mineral wool layer extending across the peripheral and medial regions of the shielding layer improves the thermal insulation capability of the liner device, and forms a flow barrier along the engaged edges of the burner box and tube interface plate. Sandwiching the base portion(s) of the angle fastener(s) in-between the shielding and insulating layers restricts the ability of the angle fastener(s) to move in out-of-plane directions, thus preventing excessive displacement of the tube section(s) relative to the base section, when subjected to mechanical loads. Here, the term "mineral wool" may also cover materials obtained directly from such wool, for instance felt.

In yet further embodiments, a cross-sectional dimension of the through-hole in the shielding layer is smaller than a further cross-sectional dimension of the further through-hole in the insulating layer, so that an annular edge region of the shielding layer associated along the inner periphery is not covered by the insulating layer. An annular recess or void is formed in this part of the insulating layer that directly surrounds the outer surface of the tube section. This recess/void terminates on the base portion of the angle fastener and on the second surface of the shielding layer.

The annular recess in the base section and directly around the tube section allows a protruding edge of a heat exchanger conduit to be accommodated by the liner device, so as to prevent such a conduit edge from exerting compressive forces on the base section and/or shear forced on the angle fastener(s).

In device embodiments including an attachment layer in the base section, the liner device may further include a stitch connection that extends in a continuous path across the medial region and around the inner periphery of the base section. This stich connection passes repeatedly back-and-forth through the shielding layer and the attachment layer.

This stitch connection fixes the shielding and attachment layers together in regions where the angle fasteners reside, thus preventing excessive displacement of the angle fasteners and tube sections relative to the base section, when subjected to mechanical loads. In embodiments that also include the insulating layer, the stitch connection may also pass repeatedly through the insulating layer, to improve mechanical robustness and further immobilize the angle fasteners and tube sections.

In further embodiments, the liner device includes at least two tube sections, and the base section includes at least two corresponding through-holes. In this case, the continuous path of the stitch connection may be composed of concave path sub-sections that extend partially around respective through-holes. These path sub-sections are interconnected in series such that consecutive path sub-sections extend alternatingly along corresponding halves of the through-holes on opposite sides thereof, and such that the continuous path intersects itself in-between the through-holes.

This stitch connection extends in a continuous and self-intersecting path around all the tube sections, and terminates on its starting point. Such a closed self-intersecting pattern facilitates manufacturing by minimizing the efforts required for aligning the starting position of a sewing device with the base section and each of the tube sections.

In embodiments, the device includes a further stitch connection that extends in a continuous pattern along the peripheral region of the base section, thereby passing alternatingly and repeatedly through the shielding layer, through the insulating layer, and around an outer periphery of the base section.

The stitch connection along and through the outer periphery holds layers together, and simultaneously confines these layers from lateral directions ±X, ±Y in order to lower the probability that fiber filaments become separated from the base section 52. This stitch connection preferably is applied along the entire periphery of the base section.

In embodiments, the tube section is formed by bending an initially planar sheet of flexible mesh of flame-resistant fibers around the nominal axis into a tubular shape, and by attaching two overlapping edges of the initially planar sheet to each other using staples or stiches.

The tube section(s) can be manufactured easily and reliably, by rolling up fiber mesh and sewing or stapling together the overlapping edges of this mesh. The tube section(s) may be made from the same fireproof mesh material as is used for forming the shielding layer.

In further embodiments, the liner device includes at least one further tube section with an associated nominal axis. Here, the nominal axes of the tube sections may be mutually parallel and may span a sagittal plane transverse to the base section, and the overlapping edge portions of the tube sheets may be at substantially identical orientations while facing transversely away from the sagittal plane.

In embodiments wherein the leg portion of the angle fastener is fixed to the outer surface of tube section using flame-resistant staples or stitches, these staples/stitches preferably extend through only a single layer of tube mesh sheet. The above-mentioned orientation of overlapping sheet edge portions creates asymmetry between the two sides of sagittal plane, while simultaneously ensuring that all flame-resistant staples or stitches remain accessible/visible along in-plane directions. The asymmetric geometry can be exploited to optimize the orientation of the device inside the furnace and relative to gravity, while the accessibility of the staples or stitches ensures that the sewing or stapling device used during manufacturing will not be obstructed when applying these staples/stitches.

In a second aspect, and in accordance with the advantages and effects described herein above, there is provided a furnace accommodating a liner device according to the first aspect. The furnace includes a heat exchanger housing, one or more conduits, an interface plate, a burner unit, and the liner device placed between the burner unit and the interface plate. The heat exchanger housing encloses a plenum, and is configured to allow a flow of gas to pass through the plenum. The burner unit is configured to receive and ignite a flammable fluid inside a burner chamber, in order to produce a flow of heated fluid. The one or more conduits are configured to receive the flow of heated fluid from the burner unit via inlets, and to convey the heated fluid through these conduits and through the plenum, while allowing heat from the heated fluid to be conducted through walls of the conduits, in order to transfer the heat to the gas in the plenum. The interface plate mechanically supports the at least one conduit on one side of the interface plate, and is configured to support the burner unit on an opposite side of the interface plate, so that the conduit and the burner unit are in fluid communication via the inlet. The base section of the liner device is placed on the opposite side of the interface plate, in-between the burner unit and the interface plate, with the first surface of the shielding layer facing the burner chamber and the second surface facing the interface plate. The tube section(s) of the liner device project away from the second surface, via the inlet, into the conduit(s). The base portions of the one or more angle fasteners are positioned along and fixed to the second surface, and the leg portions are positioned along and fixed at or near proximal tube end to the outer surface of the tube section, such that the base section and the tube section shield the angle fastener from the burner chamber.

According to a third aspect, with advantages and effects described herein above, there is provided a method of manufacturing a liner device according to the first aspect. The method includes:

- providing a shielding layer formed from a thin planar sheet that consists essentially of a flexible mesh of flame-resistant fibers, this layer defining first and second surfaces on opposite sides thereof;
- providing a through-hole that extends from the first surface to the second surface through the shielding layer, said hole being bounded by an inner circumference;
- providing a tube section consisting essentially of a flexible mesh of flame-resistant fibers formed into a tubular shape that defines a channel around a nominal axis;
- placing the tube section with a proximal end at the base section, so that the channel opens into the through-hole and that the tube section projects away from the second surface in a direction faced by the second surface;
- providing angle fasteners and fixing leg portions of said angle fasteners along an outer surface of the tube section, and
- fixing base portions of said angle fasteners along the second surface of the shielding layer.

In embodiments, the outer surface of the tube section has at the proximal end with a cross-sectional shape that is essentially identical to a cross-sectional dimension of the inner circumference of the through-hole in the shielding layer. The step of placing the tube section with its proximal end at the base section may then include:

- coaxially aligning the nominal axis of the tube section with a center of the through-hole, and sliding the tube section with its proximal end in the through-hole.

Snugly fitting the tube section with its proximal end in the through-hole of the shielding layer maximizes the available cross-sectional area for combustion flames to project into the tube section and heat exchanger conduit, and ensures that no openings are formed in-between the tube and base sections.

In embodiments, the tube section defines a distal end on a side opposite to the proximal end, and the base portions of the angle fasteners form an integral part of an attachment layer that covers the second surface of the shielding layer along at least the medial region thereof. This attachment layer may include a cutout that defines tabs extending locally and radially inwards relative to the periphery of the through-hole. In this case, the manufacturing method may further include:

placing the shielding layer and the attachment layer in an abutting layered arrangement, so that the through-hole and cutout become aligned, thereby forming a base section;

positioning the tube section on a side of the base section faced by the first surface, such that the nominal axis of the tube section aligns co-axially with the through-hole and the cutout, and such that the distal end is directed towards and located near the first surface;

moving the tube section relative to the base section along an axial direction faced by the second surface, such that the distal end enters the through-hole and the cutout, and such that the tabs flex towards the axial direction;

continue moving the tube section relative to the base section, through the through-hole and the cutout, and along the axial direction, until the proximal end of the tube section becomes level with the shielding layer, and fixing the tabs to the outer surface of the tube section near the proximal end, using staples or stitches.

This manufacturing procedure allows angle fasteners to be formed merely by cutting openings with tabs into a planar sheet, and allows these tabs to be placed automatically in the correct positions and orientation merely by sliding the tube section(s) from the first surface side into the hole(s) of the base section (or vice versa, for this motion between base section and tube section(s) should be understood to be relative).

In embodiments, the method further includes:

providing an insulating layer with a further through-hole, the insulating layer consisting essentially of a flexible and compressible of sheet of thermally insulating wool or felt material;

positioning the insulating layer in an abutting arrangement along a medial region of the shielding layer, so that the through-hole lines up with the further through-hole, and that the shielding layer and the insulating layer enclose the base portions of the angle fasteners on opposite sides thereof, and fixing the base portions of the angle fasteners, the insulating layer, and the shielding layer to each other, using staples or stitches.

In further embodiments, a cross-sectional dimension of the further through-hole in the insulating layer is larger than a cross-sectional dimension of the through-hole in the shielding layer. The method may then further include:

leaving an annular edge region of the shielding layer along the inner periphery uncovered by the insulating layer, when positioning the shielding layer along the insulating layer, thereby forming an annular recess in the insulating layer that is bounded by the outer surface of the tube section, by the base portion of the angle fastener, and by the second surface of the shielding layer.

BRIEF DESCRIPTION OF DRAWINGS

Embodiments will now be described, by way of example only, with reference to the accompanying schematic drawings in which corresponding reference symbols indicate corresponding parts, and in which.

The figures are meant for illustrative purposes only, and do not serve as restriction of the scope or the protection as laid down by the claims.

DESCRIPTION OF ILLUSTRATIVE EMBODIMENTS

The following is a description of certain embodiments of the invention, given by way of example only and with reference to the figures.

Figure 1:
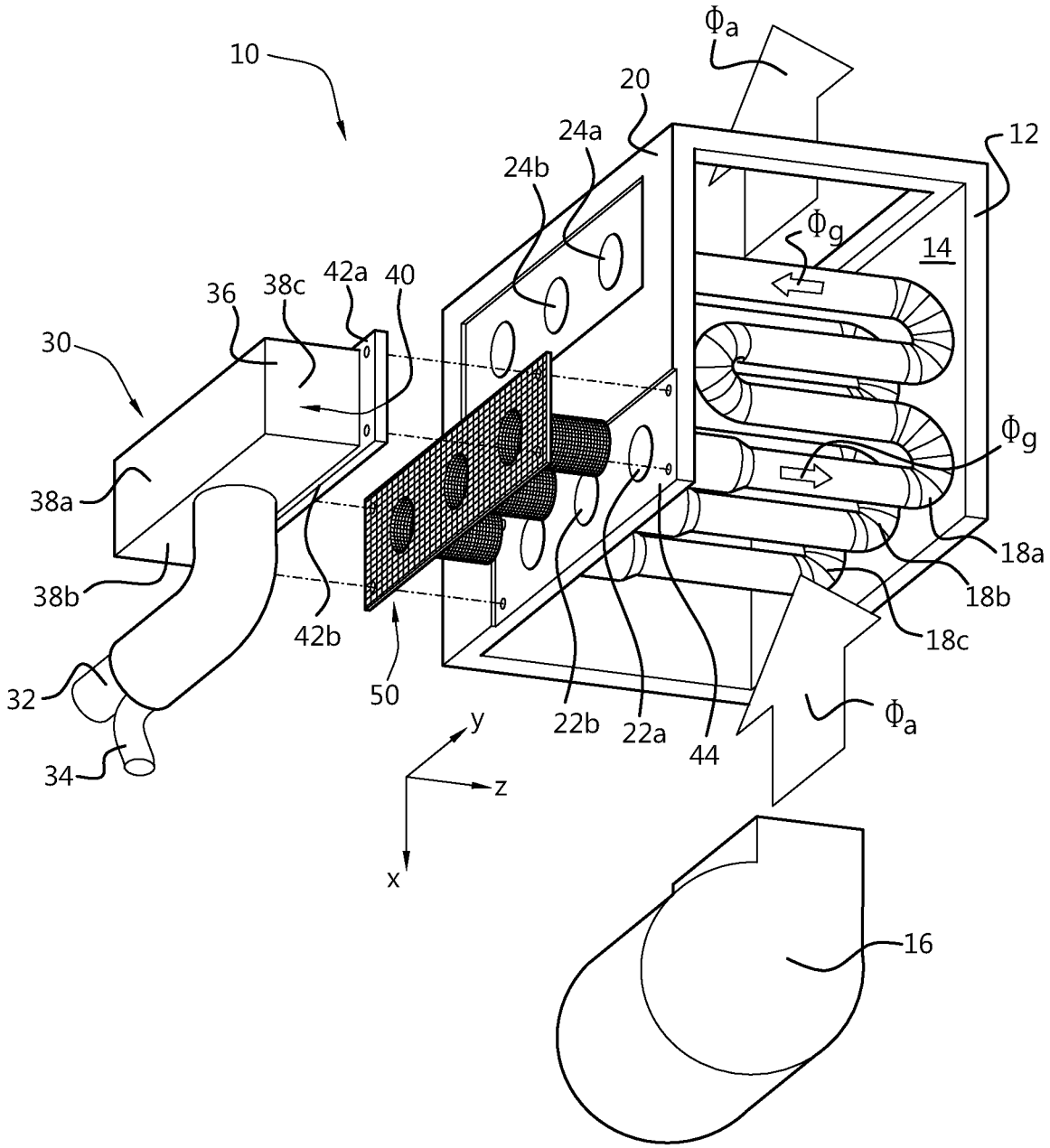
FIG. 1 schematically shows a perspective view of a heat exchanger portion of a hot air furnace, according to an embodiment.

FIG. 1 schematically shows a perspective view of part of a hot air furnace 10. This exemplary furnace 10 includes a heat exchanger (HE) housing 12 that encloses a plenum 14. A blower unit 16 is provided, which is in fluid communication with the plenum 14, and which is configured to create a directed flow of air Φa through this plenum 14. The housing 12 accommodates a plurality of individual HE conduits 18 that extend through the plenum 14. Each conduit 18 defines a sealed path that allows a gas to flow on its inner side. The conduits 18 extend along serpentine-shaped trajectories through the plenum 14, in order to provide large surface areas that allow heat from the gases inside the conduits 18 to be transferred efficiently to the air Φa that is flowing through the plenum 14. The conduits 18 may be made of metal sheet tubes that envelop the serpentine trajectories in a fluid-tight manner, so as to prevent the gasses inside the conduits 18 from mixing with the air Φa in plenum 14.

Each heat exchanger conduit 18 defines an inlet 22 and an outlet 24 on opposite distal ends of the conduit 18. The conduits 18 are mounted at or near their distal ends to an interface plate 20 that forms part of housing 12, such that the conduits 18 terminate at this interface plate 20. The inlets 22 open into a first portion of the interface plate 20, and the outlets 24 discharge at a second portion of the interface plate 20 that is remove from the first portion. The conduits 18 are fixed to the plate 20 in a sealed manner, to prevent the gasses inside conduits 18 and near interface plate 20 from leaking into the plenum 14.

A ventilation unit (not shown) and a burner unit 30 are fixed to the interface plate 20. The burner unit 30 is fluidly connected to the inlets 22, and the vent unit is fluidly coupled to the outlets 24. The burner unit 30 includes a burner box 36 having a generally hollow interior serving as burner chamber 40. The burner box 36 includes lateral and rear walls 38, while leaving open one side that faces the interface plate 20.

During operation, a mixture of fuel and air is provided to the burner box 36, which is to be ignited inside the chamber 40 to create flames and hot combustion gases. The fuel may be natural gas or propane from a fuel source (not shown), which is introduced via a fuel inlet 32. The burner unit 30 projects flames and introduces the combustion gases Φg from the open side of chamber 40, via the inlets 22, into the heat exchanger conduits 18. The vent unit extracts the combustion gases via the outlets 24 from the conduits 18 and releases these gasses to atmosphere (e.g. through a flue) after heat has been extracted from the heated combustion gases. Air necessary for combustion is drawn into the burner box 36 via an air inlet 34, as a result of underpressure created by the vent unit 26 downstream of the conduit outlets 24. A rotation speed of a fan motor of the vent unit 26 may be operatively controlled, to regulate the amount of flue gas Φg drawn from the conduits 18 via the outlets 24, the resulting overpressure of ambient air at the air inlet 32 air to flow in into the burner chamber 40. Meanwhile, the blower unit 16 conveys air Φa across the heat exchanger conduits 18, which after heating can then be conveyed by means of further ductwork towards a space that is to be heated (not shown).

FIGS. 2*a*-2*d* illustrate an embodiment of a liner device 50, which is configured to be mounted between the flanges 42 of burner box 36 on one side, and the tube interface plate 20 of the hot air furnace 10 on an opposite side.

This liner device 50 includes a base section 52 and four tube sections 54. Base section 52 extends essentially along a plane that is parallel to transverse directions X and Y, which correspond to the orientation of the interface plate 20 (FIG. 1). A third direction Z corresponds to a normal vector of this XY-plane. The tube sections 54 are individually connected at distinct locations to the base section 52, by means of angled connection members 60, 80. Each of the four tube sections 54 has a cylindrical shape, which snugly fits through an inlet 22 to cover the inner surface of a subsequent portion of a corresponding HE conduit 18. Each tube section 54 is centered on a respective centerline A, which projects parallel with the third direction Z. In this example, all four tube centerlines A are mutually parallel and lie in a sagittal plane P that is perpendicular to base section 52, such that all centerlines A intersect the base section 52 along a common midline.

Base section 52 forms a flexible laminate, which is composed of a shielding layer 58, an attachment layer 60, an insulating layer 62, and a foil layer 64. All four layers 58-64 extend mutually parallel and along the transverse directions X, Y. These layers 58-64 are fixed to each other, and together form a flexible laminate that is bendable out of the plane and compressible perpendicular to the plane, both the out-of-plane deflecting and the in-plane compressing are associated with directions ±Z. The out-of-plane flexibility of the laminate allows it to be bent by manual force from a planar rest shape into a single curved shape with a radius of curvature in the order of centimeters, without breaking and without creating substantial restoring forces that would urge the base section 52 back towards its planar state. This flexibility makes the liner device less prone to breaking and easier to adapt to the local shape of the interface plate 20 and burner box 36 (e.g. during installation).

Shielding layer 58 consists essentially of a flexible closed mesh of flame-resistant fibers. This mesh is formed as a flat and elongated rectangular surface that extends along the XY-plane. This layer 58 defines a first surface 66 on a first side that faces opposite to normal direction Z, and a second surface 67 on an opposite side that faces towards direction Z (see FIGS. 2*b*-*c*).

In this example, the mesh in shielding layer 58 is formed by a woven textile of fiber strands, each strand being formed of several intertwined fiber bundles. In this example, the fibers consist essentially of silica oxides, which are resistant to operating temperatures of up to 1000° C. These strands are grouped into warp and weft strands, which are interwoven in a plain weave pattern (i.e. a regular rectangular alternation between warp and weft strands). The strands are woven so that the adjacent strands are tightly abutting in lateral directions along the plane of the mesh, and so that the space in-between the strands is minimized to prevent formation of through-holes in-between the strands (i.e. "closed mesh"). The probability of (permanently or temporarily) forming holes is thereby minimized, and the open area percentage (i.e. ratio of strands to holes) viewed along direction Z is (close to) zero, to prevent impinging flames from passing through shielding layer 58.

The resulting layer 58 of interwoven strands is covered with a coating layer of vermiculite, at least across the first surface 66 (which is directly subjected to flames and combustion gasses from chamber 40 during operation). The thickness of this coating may for instance be approximately 150 μm.

The individual fibers in both the warp and the weft strands of the mesh have a high ultimate tensile strength (i.e. in the order of 50-150 MPa, or even higher), and high resistance against elastic and plastic deformations along the length of the fibers. These strength properties ensure that the resulting woven layer 58 remains highly resistant to breaking or in-plane warping/stretching caused by external forces exerted on the layer 58 in the warp and weft directions along the mesh plane. The tight packing of the woven strands and friction between the strands ensure that the woven layer 58 is also resistant to forces exerted on layer 58 along in-plane directions at non-zero angles relative to both the warp and weft strands, so that manual tensile and shear forces exerted along such slanted planar directions will cause no or little (i.e. <5%) local stretching of layer 58, and does not (temporarily) create holes between the warp and weft threads.

The coated mesh layer 58 is flexible (ductile) yet highly inelastic (i.e. has a low bending stiffness) in relation to out-of-the-plane folding/bending deformations. It allows the layer 58 to be folded/bent by manual force from a planar state of rest into a (single) curved shape that has a radius of curvature in the order of centimeters (or possibly even smaller), without breaking or creating substantial internal restoring forces.

Shielding layer 58 may be conceptually partitioned into a medial region 72, and a peripheral region 73 that surrounds medial region 72. The medial region 72 forms a rectangular portion that receives the tube sections 54, and which in assembled state of the furnace 10 also coincides with the open face of burner box 36. This region 72 defines four through-holes 74, which are essentially circular and aligned in a sequence. These holes 74 form passageways that extend from the first surface 66, through the shielding layer 58, to the second surface 67. These holes 74 have respective centers C, which are all aligned in a linear sequence along sagittal plane P, each center C intersecting a tube centerline A of an associated tube section 54.

The peripheral region 73 forms a rectangular loop, which surrounds the medial region 72 on all sides associated with directions X and Y. In assembled state of furnace 10, this region 73 coincides with the mounting flanges 42 of burner box 36. This region 73 defines a regular pattern of bolt holes 86 that extend through this layer 58, but are substantially smaller than the through-holes 74 (e.g. by a factor of 3 or more). These bolt holes 86 provide passage to bolts (not shown), which allow the flanges 42 of the burner unit 30, the liner device 50, and the interface plate 20 of the HE housing 12, to be mutually attached and aligned.

Figure 2A:
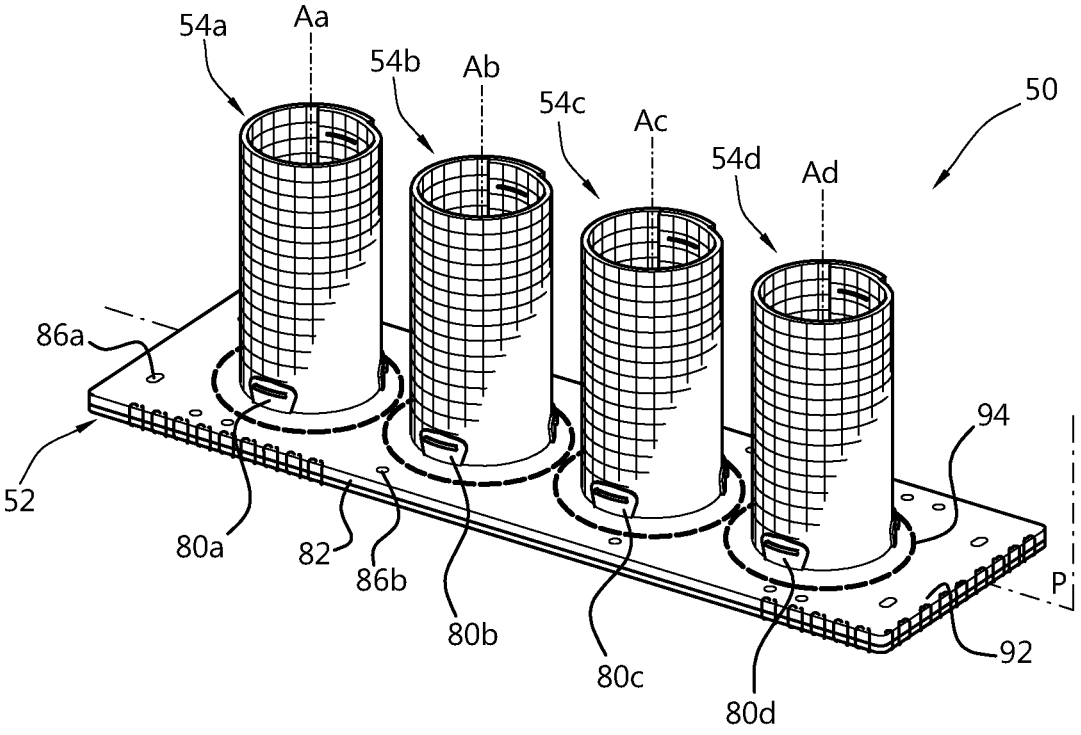
FIG. 2*a* schematically presents a perspective view of a liner device according to an embodiment.
Figure 2B:
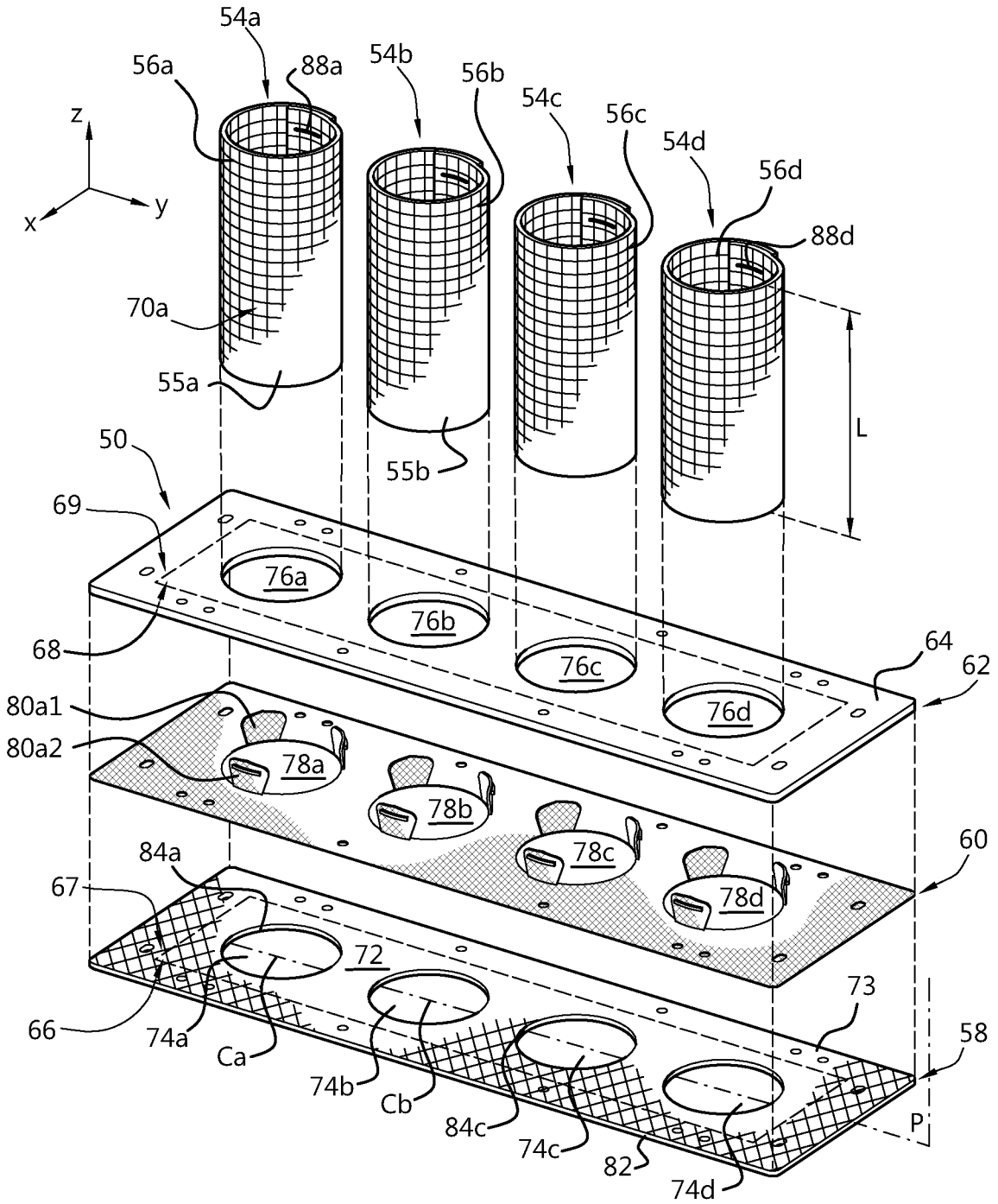
FIG. 2*b* schematically shows an exploded view of the liner device from FIG. 2*a;*
Figure 2C:
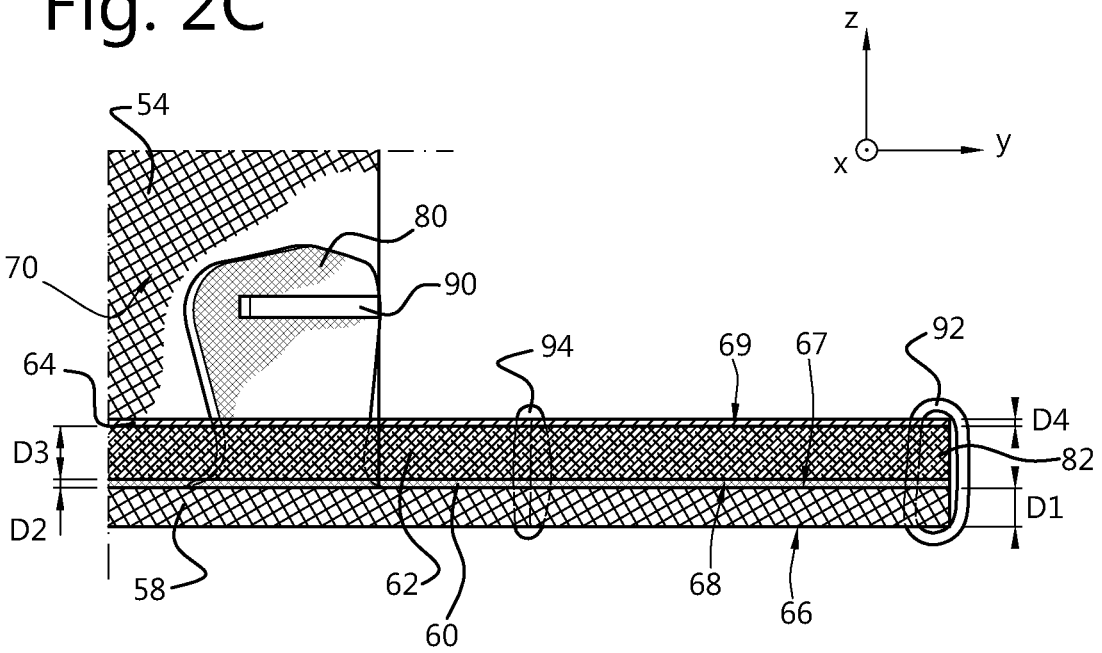
FIG. 2*c* schematically shows a side view of part of the liner device from FIG. 2*a;*
Figure 2D:
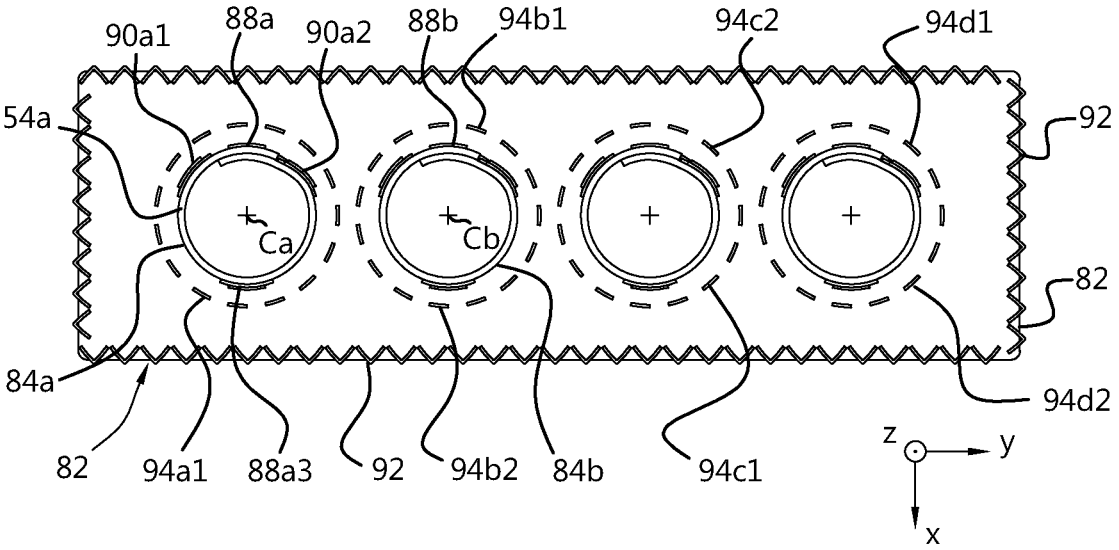
FIG. 2*d* schematically shows a top view of the liner device from FIG. 2*a;*

The insulating layer 62 is also formed as a planar surface with an elongated rectangular outer contour, with identical size and outer shape as shielding layer 58. The insulating layer 62 defines a third surface 68 located on one side facing opposite to direction Z, and a fourth surface 69 on an opposite side facing towards Z (FIGS. 2*b*-*c*). Layer 62 is sandwiched between layers 58-60 on one side and layer 64 on its other side. This layer 62 covers the second surface 67 of shielding layer 58, along both regions 72, 73. The insulating layer 62 defines four further through-holes 76, which are also essentially circular and aligned in sequence, and which form passageways that extend from the third surface 68, through the insulating layer 62, to the fourth surface 69. These further through-holes 76 have essentially identical sizes and shapes as through-holes 74, and have their respective centers mutually aligned (also with the sagittal plane P and tube centerlines A), so that the holes of layers 58 and 62 coincide pair-wise.

In this example, the insulating layer 62 is formed of pressed felt (or paper), which is formed by an unordered and non-woven multitude of inorganic fibers. These fibers consist essentially of mineral material, which is chemically inert and resistant to flames and temperatures up to 1300° C. The insulating layer 62 has a bulk thermal conductivity that is lower than 0.25 Watts per meter Kelvin at 1000° C. This layer 62 defines pockets of air in-between the pressed fibers, resulting in a filling factor (corresponding to a volumetric fiber-to-air ratio) in a range of 40%-70%. The low thermal conductivity, disordered arrangement of fibers, and presence of stationary air pockets, ensures that the entire layer exhibits very low thermal conductance (e.g. in the order of 1 Watt per Kelvin at 1000° C.), in particular for heat flowing from the third surface 68, through layer 62, to the fourth surface 69.

Layer 62 has flexibility and inelasticity properties in relation to out-of-the-plane folding/bending deformations, which are similar to those of the shielding layer 58. However, due to the chaotic and loosely connected arrangement of fibers that form the felt, layer 62 is significantly less resistant (i.e. a factor of at least 10) to rupturing or in-plane warping/stretching caused by external forces exerted on the layer 62 along in-plane directions, as compared to shielding layer 58.

In this example, attachment layer 60 is sandwiched between layer 58 on one side and layers 62-64 on its other side. Layer 60 directly abuts and overlaps both regions 72 and 73 of shielding layer 58. This layer 60 forms a plurality of angle fasteners 60, 80, which are at fixed positions relative to each other, and which form intermediate structures that mechanically interconnect the tube sections 54 with the base section 52.

Attachment layer 60 consists essentially of a flexible open mesh of very thin metallic fibers (e.g. ≤0.5 mm diameter), formed into a flat and elongated rectangular surface that largely matches the shapes of layers 58 and 62. In this example, the metallic fibers consist essentially of strengthened FeCrAl alloy that can withstand operating temperatures of up to 1100° C. for a prolonged time without structural failure. These fiber strands are interwoven into a plain weave pattern, and are fixed to each other at the crossing points of the mesh, for instance by welding or diffusion bonding. The fiber strands are interwoven in an open arrangement, such that adjacent parallel strands (either warp or weft) are at non-zero mutual distances viewed in directions along the plane of the mesh, to leave open through-holes in-between strands. An open area percentage viewed along direction Z may be in a range of 30%-70%, which allows staples or stiches to be easily applied through layer 60 at any desired location.

In this example, the individual fibers in both the warp and the weft strands of the metallic mesh have a considerable ultimate tensile strength (i.e. in the order of 600 to 800 MPa, possibly higher), and considerable resistance against elastic and plastic deformations along the length of the fibers. These strength properties ensure that the open mesh layer 60 remains highly resistant to breaking and in-plane warping/stretching caused by forces exerted along in-plane directions on the layer 60, and ensure that local peak tensile loads exerted via any present stitches or staples cause no or only little (i.e. less than 5%) local stretching of layer 60. The layer 60 is nevertheless flexible to allow out-of-the-plane folding/bending, similar as described above for layer 58.

This attachment layer 60 includes cut-outs 78 that are aligned with corresponding through-holes 74, 76 in layers 58 and 62. The shape of each cut-out 78 is circumscribed by the inner peripheries 84 that bound the holes 74 in layer 58. Each cut-out 78 includes a rotationally repeating shape variation that yields three tabs 80 in a nearly rotationally symmetric arrangement. These tabs 80 initially protrude inwards from the periphery 84 of a coinciding through-hole 74, towards the center C of the through-hole. All tabs 80 form extensions of the attachment layer 60, this layer 60 forming a common base that fixes the positions of all tabs 80 relative to base section 52. By flexing the tabs 80 towards direction +Z (see FIG. 2*b*), these tabs 80 can act as attachment leg portions. The flexed tabs 80 are placed alongside the outer surfaces of 70 respective tube sections 54, and fixed to those tube sections 54 by locally driving one or more staples 90 through each paired tab 80 and tube section 54.

In this example, the insulating layer 62 is covered on its fourth surface 69 by a cover layer 64 (FIG. 2*c*). This cover layer 64 also forms a planar surface with a rectangular outer contour, having a size and outer periphery identical to the other layers 58-62. Layer 64 also defines through-holes (not indicated) that coincide with through-holes 74 and 76 in layers 58 and 62, and bolt holes (not indicated) that coincide with the bolt holes in layers 58-62. Layer 64 is formed from a thin continuous layer of non-porous foil material, thus forming an effective mechanical barrier for keeping the unordered inorganic fibers of the insulating layer 62 in place. In this example, cover layer 64 consists essentially of aluminum foil, which is very thin in the through-plane direction (e.g. in a range of 10-100 μm) to allow piercing by staples or stitches, and which is attached in advance (i.e. before layers 62 and 64 are fixed to layers 58 and 60) to insulating layer 62. This foil layer 64 is ductile and inelastic in relation to deformations perpendicular to the XY-plane, but resistant against stretching/skewing along the XY-plane. The foil material further may have a high bulk thermal conductivity (e.g. at least 200 W/m·K).

The layers 58-62 are mechanically interconnected by means of a first stitch connection 92 and a second stitch connection 94. These stitch connections 92, 94 are made at least in part of flame resistant fibers, yarns, or twines. The stitching threads may for instance be formed of a metallic yarn (e.g. high temperature resistant iron alloy) that is embedded in a sheath of moldable non-metallic material (e.g. plastic) with relatively low surface friction characteristics, or which is intertwined with a thicker non-metallic low-surface-friction yarn (e.g. made of cotton, nylon, etc.). This non-metallic sheath or additional yarn may be burnable, and allowed to burn away when the installed liner device 50 is subjected to flames and heat from the burner chamber 40, provided that the flame-resistant part of the stich connections 92, 94 remain structurally intact.

The first stitch connection 92 is formed by a continuous thread of such yarn, which is applied in a zigzag pattern that traces out a continuous path across the peripheral region 73 of the base section 52. These stitches 92 pass repeatedly through the layers 58-64, and curve repeatedly around the outer periphery 82 of base section 52 to enclose layers 58-64 from lateral directions ±X, ±Y, thereby lowering the probability that fiber filaments from layers 58 or 62 become separated from base section 52.

The second stitch connection 94 is also formed by a continuous thread of such yarn material, and traces out a continuous path across the medial region 72 of base section 52, while extending back-and-forth through the layers 58-64. This path closely follows the inner peripheries 84 that bound the through-holes 74 in layer 58. The path of stitch connection 94 remains at a distance in the order of 3 to 6 of millimeters (e.g. 4.5 mm) away from these inner peripheries 84, to ensure that sufficient layer material is present on both sides of the stiches 94. This allows the connection 94 to remain intact under normal handling conditions (e.g. during manual installation of device 50), while ensuring that attachment layer 60 is held fixed along the XY-plane to prevent excessive out-of-plane flexing of tabs 80. The continuous path of connection 94 is composed of semi-circular path sub-sections 94*a*1, 94*b*1, etc (see FIG. 2*d*). Each respective sub-section extends around one half of a coinciding set of through-holes. These arcuate subsections are interconnected in series, and curve in a meandering fashion around the through-holes, in such a manner that the path 94 extends around all through-holes, while intersecting itself at points that lie in-between the through-holes and on the sagittal plane P.

The tube sections 54 consists essentially of a flexible mesh of flame-resistant fibers. In this example, the material and structure of the precursor mesh sheets used for the tube sections 54, are the same as for shielding layer 58. This layer of interwoven fiber strands is also covered with a coating of vermiculite (e.g. with a thickness of approximately 150 μm), at least across inner surfaces of the tube sections 54, which are exposed to flames and combustion gasses during operation.

Each tube section 54 has been formed from a quadrilateral precursor sheet of fiber mesh. Two opposite lateral edges of the initially flat precursor sheet are moved towards each other in order to bend the initially flat precursor sheet into a cylindrical shape around a respective centerline A, thereby enclosing an channel along this centerline A. These lateral edges are made to overlap, and are fixed to each other by applying a sequence of (e.g. three) staples 88 along the region of overlap. Due to this overlap, the outer surface 70 of tube section 54 is predominantly smoothly curved, except from an abrupt surface transition in the region of overlap, with a magnitude equal to a sheet thickness.

Each tube section 54 defines two tube apertures, one aperture being located on a proximal end 55 and one aperture on a distal end 56 of the tube. The outer surface 70 near proximal tube end 55 has a shape that closely matches the inner shape of holes 74 and 76, except at the overlap region where the outer surface 70 abruptly recedes (see FIG. 2*d*). The tube sections 54 are placed with their proximal tube ends 55 onto the base section 52, so that the outer surface 70 at the proximal end 55 snugly fits inside holes 74 and 76, and abuts the inner periphery 84 of layers 58, 62, 64 delineating these holes 74, 76. Outer surface 70 also snugly fits inside hole 78 in attachment layer 60, provided that the tabs 80 are flexed upwards. After placement, the tube section 54 extend away from the base section 52 such that its distal tube end 56 is located at a distance equal to the tube length L from the first surface 66. Each tube section 54 is aligned with a respective sequence of through-holes 74, 76, 78, such that the tube centerlines A coincide with center points C of corresponding holes 74, 76, 78.

In this example, the thickness dimensions of the laminate of layers 58-64 are as follows (see FIG. 2*c*): Shielding layer 58 has a thickness D1 in a range of 2-3 millimeters. Here, the tube sections 54 are made from precursor sheet composed of the same material as shielding layer 58, and have a comparable (radial) thickness in a range of 2-3 millimeters. In this example, length L is approximately 100 millimeters. Attachment layer 60 has a thickness D2 in a range of 0.3-0.5 millimeters. Insulation layer 62 has an uncompressed thickness D3 in a range of 3-5 millimeters, but can be compressed along the normal direction Z in a reversible manner (i.e. with only little permanent deformation), by an extent of several millimeters, to obtain a reduced thickness in a range of 2-3 millimeters. Cover layer 64 has a thickness D4 in a range of 20-40 micrometers. A total thickness Dt of the uncompressed laminate is in a range of about 5 to 8 millimeters. However, the laminate can be compressed to a reduced total thickness in a range of about 4-6 millimeters, so that peripheral region 73 of the device 50 can additionally serve as a gasket between the interface plate 20 and the flanges 42 of burner box 30.

The exploded view of the exemplary embodiment in FIG. 2B further illustrates that each of the tube sections 54 defines a distal end 56 that is opposite to the proximal end 55. In this example, all base portions of the angle fasteners form part of the same attachment layer 60. This attachment layer 60 may be formed by initially providing a sheet of metal mesh, and forming cutouts 78 in this sheet, thereby forming three tabs 80 that extend radially inwards (i.e. along ±X, ±Y; not shown) relative to the peripheries 84 of the other through-holes 74, 76. In this example, the tabs 80 associated with each distinct tube section 54 are arranged in a 105°-127½°-127½° angular distribution around the respective hole center, with the 105°-angle between the pair of tabs located around staple 88 on the upwards side shown in FIG. 2*d*. This angular distribution of tabs 80 allows a stapler or sewing device to radially engage these tabs 80 (when flexed upwards as in FIG. 2*b*), without being obstructed by neighboring tube sections 54.

After forming the laminated base section 52 by joining together the layers 58-64, the separate tube sections 54 may be positioned on a lower side of the base section 52 that is faced by the first surface 66, with the distal ends 56 directed towards and positioned nearest to this first surface 66 (not shown). Here, each tube section 54 is paired with an associated cutout 78 and set of through-holes 74, 76, and the nominal axes A of the tube sections 54 are co-axially aligned with respective centers C of associated through-holes 74, 76 and cutouts 78.

The tube sections 54 may then be moved relative to the base section 52 along the axial direction Z, such that each distal ends 56 enters the associated set of through-holes 74, 76 and cutout 78, and such that the tabs 80 flex towards the axial direction Z (the orientation in FIG. 2*b*). The tube sections 54 are then moved further through their associated through-holes 74, 76 and cutouts 78, towards direction Z and relative to the base section 52, until the proximal ends 55 of the tube section becomes level with the shielding layer 58. The folded tabs 80 are then fixed to the outer surfaces 70 of the tube section 54 near their proximal ends 55, using stapling or sewing techniques.

Figure 3A:
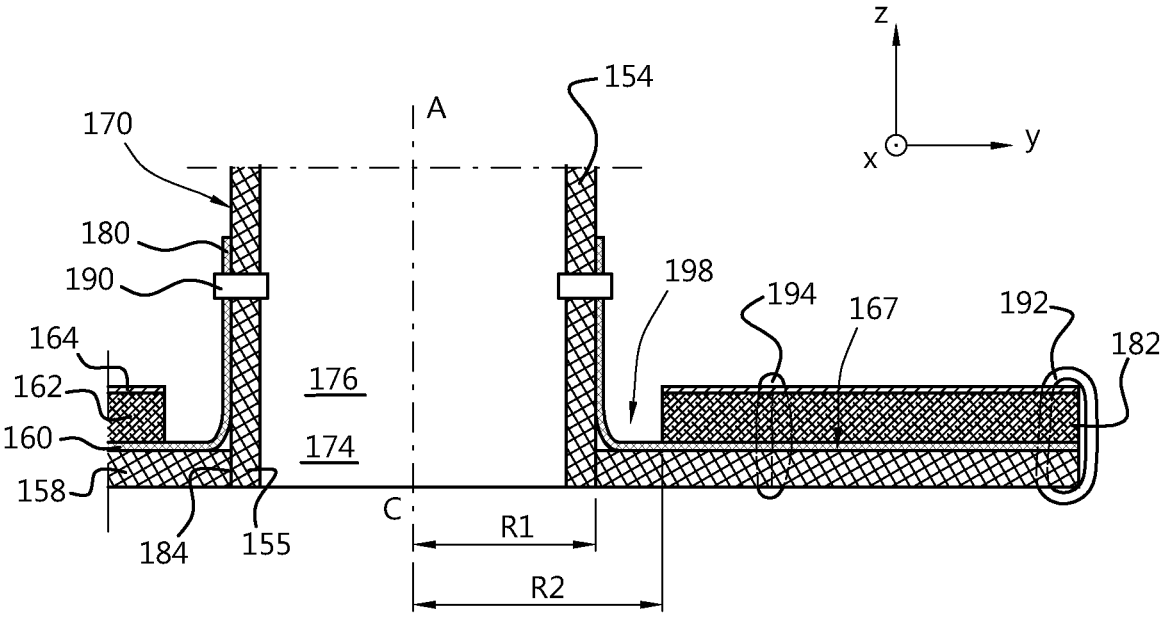
FIG. 3*a* schematically shows a cross-sectional side view of part of a liner device according to another embodiment, and FIG. 3*b* schematically shows a top view of the liner device from FIG. 3*a*.
Figure 3B:
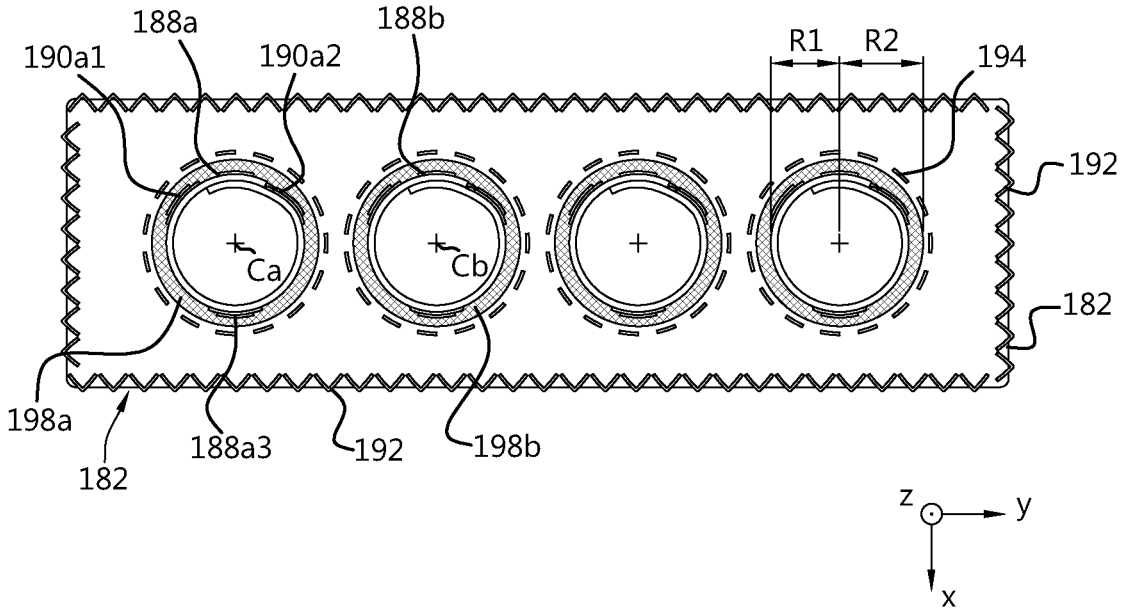

FIGS. 3*a*-3*b* show another embodiment of a liner device 150. Features that have already been described above with reference to the first device embodiment 50 (FIGS. 2*a-d*) may also be present in the device 150 shown in FIGS. 3*a-b*, and will not all be discussed here again. For the discussion with reference to FIGS. 3*a-b*, like features are designated with similar reference numerals preceded by 100, to distinguish the embodiments.

Also here, the shape of the outer surface 170 near end 155 of tube section 154 closely matches the inner shape of hole 174 in the shielding layer 158, except at the overlap region in tube section 154 where outer surface 170 abruptly recedes over one sheet thickness (see FIG. 3B). Once the tube sections 154 are placed with their proximal tube ends 155 onto the base section 152, the outer surfaces 170 snugly fit inside holes 174 as well as inside the holes in attachment layer 160 that result when tabs 180 are flexed upwards.

However, in the embodiment 150 of FIGS. 3*a-b*, radius R1 of hole 174 is smaller than radius R2 of hole 176 in insulating layer 162 (and foil layer 164). The maximum radius (not indicated) of the cut-out in layer 160, when tabs 180 are folded upwards, is also smaller than R2. As a result, an annular region of layers 158 and 160 projects inwards beyond the layers 162 and 164 and up to the inner periphery 184 around hole 174, and remains uncovered by layers 162 and 164. This creates an annular recess 198 directly around the outer surface 170 of tube section 154, which recess 198 is bounded in downwards direction −Z on layer 160, bounded in radially inwards directions by the tabs 180 and the outer surface 170 of the tube section 154, and bounded in radially outwards directions by inner peripheries of layers 162 and 164. A projecting edge of a HE conduit 18 at an inlet 22, which might project relative to the surface of interface plate 20, can be accommodated in this recess 198. The recess 198 prevents such a conduit edge from exerting compressive forces on the base section 152 and shear forces on the tabs 180, while allowing excess heat accumulated at this conduit edge to be quickly conducted by the metal mesh 160 along in-plane directions.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. It will be apparent to the person skilled in the art that alternative and equivalent embodiments of the invention can be conceived and reduced to practice. All changes which come within the meaning and range of equivalency of the claims are to be embraced within their scope.

For instance, the liner device according to an aspect of the invention was described in the above examples in combination with a hot air furnace. However, the liner device may be adapted to be implemented for use in any heating system that includes flue gas conduits and operates based on combustion flames, such as hot water boilers, fire-tube boilers, and industrial furnaces. The length L of the tube section(s) is adapted to extend inside the conduit(s) over at least the expected typical length over which combustion flames project inside the conduit(s) during operation. This length L exceeds the length of the leg portion(s) of the angle fastener(s), is several times larger than the thickness of the base section, and is at least ¼ times but preferably more than ½ times a smallest width (i.e. smallest in-plane dimension) of the base section.

The fibers in the shielding layer may be made from other inorganic (e.g. mineral or glass) fiber materials, and/or the fibers may be coated with other types of heat-resistant inorganic material. Similarly, the open mesh in the attachment layer may be composed (e.g. woven and bonded together) from other types of flexible continuous fiber materials that are resistant to high temperatures (e.g. above 1100° C.), have high ultimate tensile strength (e.g. above 500 MPa), and are thin (e.g. diameter below 0.5 mm). Suitable fiber materials are for instance alumina fiber (ALF) or alkaline earth silicate (AES) fiber. Alternatively, punched sheet metal with similar properties (sheet thickness lower than 0.5 mm, etc.) may be used.

Alternatively or in addition, the tube sections of fiber mesh may be formed into other tube shapes having discrete rotational symmetry about the tube axis. For instance, elliptic tube shapes, conical tube shapes, or prismatic tube shapes (e.g. triangular, rectangular, etc.) may also be possible.

In contrast to the examples discussed herein, alternative devices may be conceived in which the angle fastener defines a base portion that is positioned along and fixed to the first surface of the shielding layer, and/or defines a leg portion that is positioned along and fixed at or near the tube end to an inner surface of the tube section. This, however, will expose the angle fastener to intense heat and/or flames when the furnace is in use, and potentially leads to quick failure of the interconnection. In yet other alternatives, the angle fastener may have a base portion being unitary with the shielding layer, said base portion forming a direct extension of this shielding layer, which initially protrudes inwards into the through-hole, and which is flexed upwards to be fixed to the tube section. The resulting flexure stress, however, may increase the likelihood of warping or misaligning the tube section during manufacturing and/or during furnace operation.

LIST OF REFERENCE SYMBOLS

10 hot air furnace
12 heat exchanger housing
14 plenum
16 blower unit
18 heat exchanger conduit
20 interface plate
22 conduit inlet
24 conduit outlet
26 vent unit
30 burner unit
32 fuel supply
34 air supply
36 burner box
38 box walls
40 burner chamber
42 mounting flange (on burner chamber)
44 mounting surface (on conduit housing)
46 bolt
50 liner device

52 base section
54 tube section
55 proximal tube end
56 distal tube end
58 shielding layer (fiber mesh)
60 attachment layer (e.g. metal mesh)
62 insulating layer (e.g. mineral wool)
64 cover layer (e.g. continuous metal film)
66 first surface
67 second surface
68 third surface
69 fourth surface
70 outer tube surface
72 medial region
73 peripheral region
74 through-hole (in medial region)
76 further through-hole
78 cutout (profiled through-hole in metal mesh)
80 attachment tab
82 outer periphery
84 inner periphery
86 bolt hole (in peripheral region)
88 first staple connection (along edges of tube mesh)
90 second staple connection (through tab and tube)
92 first stitch connection (along outer edge of base)
94 second stitch connection (through base and around through hole)
96 third stitch connection (along outer edge of tube)
198 recess
A tube centerline
C hole center
P sagittal plane
L tube length
R1 radius of through-hole
R2 radius of further through-hole
X first direction (in-plane)
Y second direction (in-plane)
Z third direction (out-of-plane)
Φg flue gas flow
Φa air flow

What is claimed is:

1. A liner device, adapted to be mounted between a burner box and a tube interface plate of a furnace, the liner device comprising:

a base section, including a shielding layer formed from a first flexible mesh of flame-resistant fibers, the shielding layer defining a first surface that is configured to face the burner box, a second surface opposite to the first surface, and a medial region with a through-hole forming a passageway through the shielding layer;

a tube section, consisting essentially of a second flexible mesh of flame-resistant fibers formed into a tubular shape that defines an internal channel around a nominal axis, a proximal end of the tube section being positioned at the base section, such that the channel opens into the through-hole and that the tube section projects from the second surface and in a direction faced by the second surface;

an angle fastener, having a base portion that is positioned along and fixed to the second surface of the shielding layer, and having a leg portion that projects towards the second direction and is positioned along and fixed to an outer surface of the tube section at or near the proximal end thereof, wherein the base portion of the angle fastener is an integral part of an attachment layer that covers the second surface of the shielding layer along at least the medial region, the attachment layer including a cutout having a shape that is circumscribed by the periphery of the through-hole, said cutout extending locally and radially inwards to define a tab that forms the leg portion when flexed towards the second direction.

2. The liner device according to claim 1, wherein the attachment layer defines at least three tabs that protrude from the edge of the through-hole and are arranged in a regular angular distribution around the edge of the through-hole, forming leg portions of three respective angle fasteners.

3. The liner device according to claim 1, wherein the attachment layer is formed by an open mesh or punched sheet, the open mesh or punched sheet having a low bending resistance against out-of-plane flexing, and a high shear resistance against in-plane deformation.

4. The liner device according to claim 1, wherein the leg portion of the angle fastener is fixed to the outer surface of the tube section using flame-resistant staples or stitches made of flame-resistant yarn, or wherein the base portion of the angle fastener is fixed to the second surface of the shielding layer using flame-resistant staples or stitches made of flame-resistant yarn, or both.

5. The liner device according to claim 1, wherein the shielding layer further defines a peripheral region surrounding the medial region, and wherein the device further comprises an insulating layer that is fixed to and overlaps with the second surface of the shielding layer along at least the entire peripheral region, the insulating layer being compressible and configured to form a gasket between the mounting flanges of the burner box and the interface plate of the furnace.

6. The liner device according to claim 5, wherein the flexible and compressible material of the insulating layer consists essentially of thermally insulating mineral wool, wherein the insulating layer defines a further through-hole and overlaps with the second surface of the shielding layer along the medial region such that the through-hole and further through-hole align, and also overlaps with the base portion of the angle fastener, such that the shielding layer and the insulating layer enclose the base portion on opposite sides thereof.

7. The liner device according to claim 6, wherein a cross-sectional dimension of the through-hole in the shielding layer is smaller than a further cross-sectional dimension of the further through-hole in the insulating layer, so that an annular edge region of the shielding layer along the inner periphery is not covered by the insulating layer, forming an annular recess in the insulating layer and directly around the outer surface of the tube section, said recess terminating on the base portion of the angle fastener and on the second surface of the shielding layer.

8. The liner device according to claim 1, further comprising a stitch connection extending in a continuous path across the medial region and around the inner periphery of the base section, thereby passing repeatedly back-and-forth through the shielding layer and the attachment layer.

9. The liner device according to claim 8, comprising at least two tube sections, and the base section comprising at least two corresponding through-holes;

wherein the continuous path of the stitch connection is composed of concave path sub-sections that extend partially around respective through-holes, the path sub-sections being interconnected in series such that consecutive path sub-sections extend alternatingly along corresponding halves of the through-holes on opposite sides thereof, and such that the continuous path intersects itself in-between the through-holes.

10. The liner device according to claim 1, comprising a further stitch connection extending in a continuous pattern along the peripheral region of the base section, thereby passing alternatingly and repeatedly through the shielding layer, through the insulating layer, and around an outer periphery of the base section.

11. The liner device according to claim 1, wherein the tube section is formed by bending an initially planar sheet of flexible mesh of flame-resistant fibers around the nominal axis into a tubular shape, and by attaching two overlapping edges of the initially planar sheet to each other using staples or stiches.

12. The liner device according to claim 11, comprising at least one further tube section with an associated nominal axis, the nominal axes of the tube sections being parallel and spanning a sagittal plane transverse to the base section;

wherein the overlapping edge portions of the tube sheets are at substantially identical orientations and face transversely away from the sagittal plane.

13. A furnace, comprising:

a heat exchanger housing enclosing a plenum, and configured to allow a flow of gas to pass through the plenum;

a burner unit, configured to receive and ignite a flammable fluid inside a burner chamber, in order to produce a flow of heated fluid;

at least one conduit configured to receive the flow of heated fluid from the burner unit via an inlet, and to convey the heated fluid on an inside of the conduit, through the plenum, and to conduct heat from the heated fluid through a wall of the conduit, in order to transfer the heat to the gas in the plenum;

an interface plate that mechanically supports the at least one conduit on one side of the interface plate, and is configured to support the burner unit on an opposite side of the interface plate, so that the conduit and the burner unit are in fluid communication via the inlet;

a liner device according to claim 1, the base section thereof being placed on the opposite side of the interface plate in between the burner unit and the interface plate, with the first surface of the shielding layer facing the burner chamber and the second surface facing the interface plate; with the tube section of the liner device projecting away from the second surface, via the inlet, into the conduit; and with the base portion of the angle fastener positioned along and fixed to the second surface and with the leg portion positioned along and fixed at or near proximal tube end to the outer surface of the tube section, such that the base section and the tube section shield the angle fastener from the burner chamber.

14. A method of manufacturing a liner device, adapted to be mounted between a burner box and a tube interface plate of a furnace, the method comprising:

providing a shielding layer formed from a thin planar sheet consisting essentially of a flexible mesh of flame-resistant fibers, and defining first and second surfaces on opposite sides thereof;

providing a through-hole that extends from the first surface to the second surface through the shielding layer in a medial region, and which is bounded by an inner circumference;

providing a tube section comprising a thin curved sheet consisting essentially of a flexible mesh of flame-resistant fibers formed into a tubular shape that defines a channel around a nominal axis;

placing the tube section with a proximal end at the base section, so that the channel opens into the through-hole and that the tube section projects away from the second surface in a direction faced by the second surface;

providing angle fasteners and fixing leg portions of said angle fasteners along an outer surface of the tube section, and fixing base portions of said angle fasteners along the second surface of the shielding layer, wherein the base portion of each angle fastener is an integral part of an attachment layer that covers the second surface of the shielding layer along at least the medial region, the attachment layer including a cutout having a shape that is circumscribed by the periphery of the through-hole, said cutout extending locally and radially inwards to define a tab that forms the leg portion when flexed towards the second direction.

15. The method according to claim 14, wherein the outer surface of the tube section has a cross-sectional shape at its proximal end that is essentially identical to a cross-sectional dimension of the inner circumference of the through-hole, and wherein placing the tube section with its proximal end at the base section includes:

coaxially aligning the nominal axis of the tube section with a center of the through-hole, and sliding the tube section with its proximal end in the through-hole.

16. The method according to claim 14, wherein the tube section defines a distal end on a side opposite to the proximal end, wherein the base portions of the angle fasteners form an integral part of an attachment layer that covers the second surface of the shielding layer along at least the medial region thereof, the attachment layer including a cutout that defines tabs extending locally and radially inwards relative to the periphery of the through-hole, wherein the method further includes:

placing the shielding layer and the attachment layer in an abutting layered arrangement, so that the through-hole and cutout are aligned, thereby forming a base section;

positioning the tube section on a side of the base section faced by the first surface, such that the nominal axis of the tube section aligns co-axially with the through-hole and the cutout, and such that the distal end is directed towards and located near the first surface;

moving the tube section relative to the base section along an axial direction faced by the second surface, such that the distal end enters the through-hole and the cutout, and such that the tabs flex towards the axial direction;

continue moving the tube section relative to the base section, through the through-hole and the cutout, and along the axial direction, until the proximal end of the tube section becomes level with the shielding layer, and fixing the tabs to the outer surface of the tube section near the proximal end, using staples or stitches.

17. The method according to claim 14, further comprising:

providing an insulating layer with a further through-hole, the insulating layer consisting essentially of a flexible and compressible of sheet of thermally insulating wool or felt material;

positioning the insulating layer in an abutting arrangement along a medial region of the shielding layer, so that the through-hole lines up with the further through-hole, and that the shielding layer and the insulating layer enclose the base portions of the angle fasteners on opposite sides thereof;

fixing the base portions of the angle fasteners, the insulating layer, and the shielding layer to each other, using staples or stitches.

18. The method according to claim 17, wherein a cross-sectional dimension of the further through-hole in the insulating layer is larger than a cross-sectional dimension of the through-hole in the shielding layer, the method further comprising:

leaving an annular edge region of the shielding layer along the inner periphery uncovered by the insulating layer, when positioning the shielding layer along the insulating layer, thereby forming an annular recess in the insulating layer that is bounded by the outer surface of the tube section, by the base portion of the angle fastener, and by the second surface of the shielding layer.

* * * * *